US005785618A

United States Patent [19]

Coleman et al.

[11] Patent Number: 5,785,618

[45] Date of Patent: Jul. 28, 1998

[54] WEBBING USED FOR A TOSSING GAME BETWEEN PLAYERS

[76] Inventors: Thomas J. Coleman, 19170 Paddock Pl., Abingdon, Va. 24211; William K. Schlotter, IV, 117 Wateredge La., Fredericksburg, Va. 22406; Princess Ann Coleman, 19170 Paddock Pl., Abingdon, Va. 24211; Ann M. Schlotter, 117 Wateredge La., Fredericksburg, Va. 22406

[21] Appl. No.: 862,182

[22] Filed: May 22, 1997

[51] Int. Cl.[6] ..... A62B 67/00

[52] U.S. Cl. ..... 473/576; 473/596; 463/47.5

[58] Field of Search ..... 473/569, 573, 473/574, 575, 576, 596, 613, 614, 615, 197; 463/47.5

[56] References Cited

U.S. PATENT DOCUMENTS 3,931,971 1/1976 Harvey ..... 473/613

4,068,846 1/1978 Forrest ..... 473/197

5,279,482 1/1994 Dzenitis et al. ..... 473/576

5,375,848 12/1994 Coleman ..... 473/573

*Primary Examiner*—Steven B. Wong

*Attorney, Agent, or Firm*—Melvin L. Cane

[57] ABSTRACT

A web slinger throw and catch game designed for easy throwing and catching for use indoors and/or outdoors by children of all ages. The web slinger comprises a netting material or any suitable material intertwined with flexible cords. It also comprises three or more balls with at least one ball attached to each corner of the material. A finger loop is attached to the center of the netting material so that a person can easily hook his/her finger(s) through the loop for easy throwing. This combination causes the web slinger, when thrown, to flare outward and sail through the air for an easy catch by another person.

6 Claims, 1 Drawing Sheet

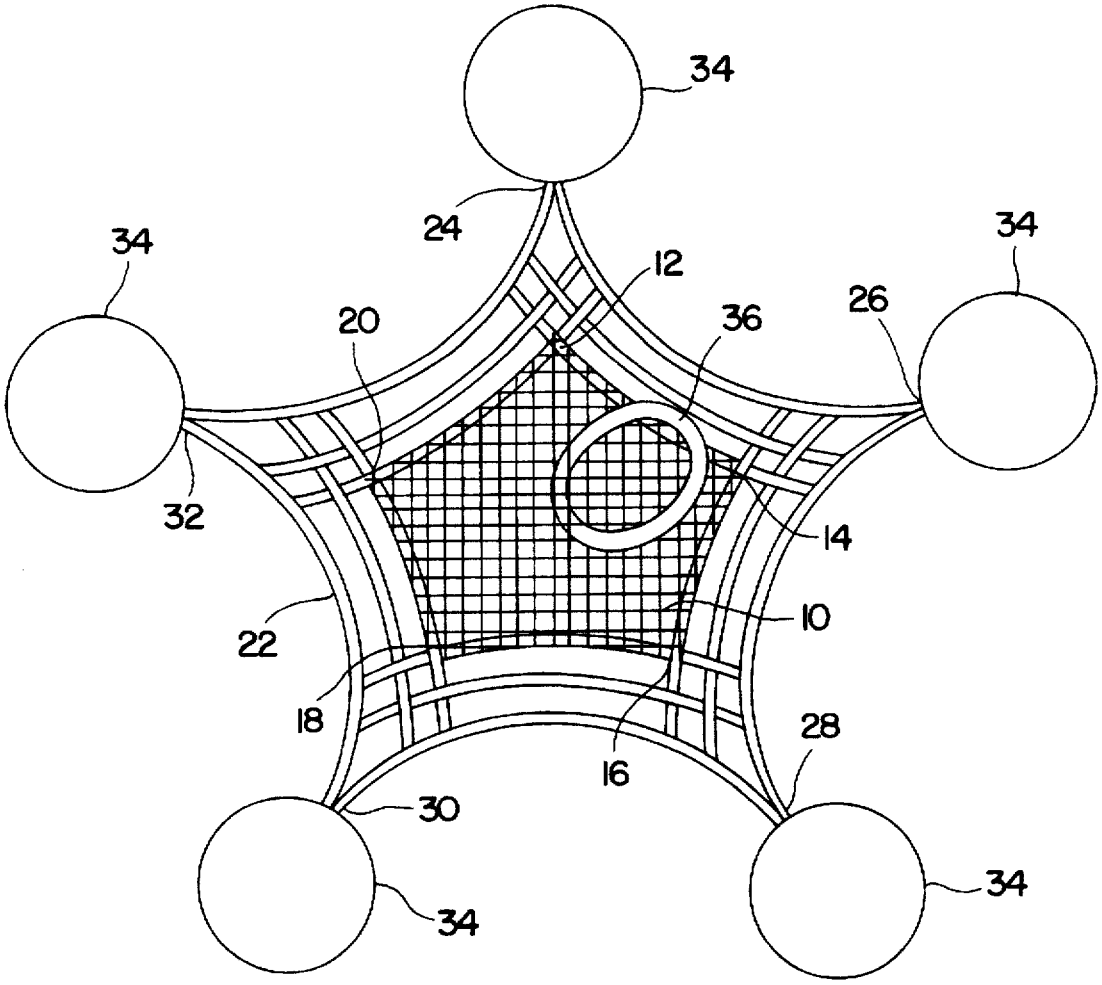
34
24
34
34
12
26
20
36
32
14
22
10
18
28
16
30
34
34

WEBBING USED FOR A TOSSING GAME BETWEEN PLAYERS

BACKGROUND OF THE INVENTION

This invention is directed to a web slinger game and, more particularly, to a web slinger game which is thrown by one person to be caught by another person.

PRIOR ART

Heretofore, various objects have been thrown by one person to be caught by another person. Such objects include baseballs, footballs, Frisbees, etc.

SUMMARY OF THE INVENTION

This invention is directed to a central net material formed by a cord-type material which has an outer border of more loosely defined or spaced cord that extends from the central netting material outwardly of the central netting material to different corners to which a ball of a soft material is secured. A central metal ring or finger loop is provided by which a person can hook his finger in order to fling the web slinger game device. When the web slinger game device is slung by a person, the device will open up to an open condition because of the centrifugal force of the balls on the corners.

It is therefore an object of the invention to provide a safe, simple game which can be played by most any aged person.

A further object is to provide a game which is thrown by one person to be caught by another person.

Still another object is to provide a game made of a netting material which could be used in a game in which the netting must be thrown so that it lands over a person's head to so-called catch the person.

While another object is to provide a throwing game which can be made in various sizes for people of different sizes or ages.

Other objects and advantages of the invention will become obvious from a clearer understanding of the drawings and following description.

BRIEF DESCRIPTION OF THE DRAWINGS

The drawing illustrates a top view of the web slinger game shown in a spread-open position.

DETAILED DESCRIPTION OF THE INVENTION

Now, referring to the drawing, there is shown a top view of the web slinger game. The device includes an inner portion 10 of a netting material formed by cord or string material which can be of any desired design. As shown, the inner netting material is formed with five corners 12, 14, 16, 18, 20 which are bounded by strands of further spaced flexible cords 22 which also end in corners 24, 26, 28, 30, and 32. Each of the corners of the further spaced cords 2 are secured to a ball 34 formed of a soft material which could be rubber, sponge or any other suitable material that would not injure a person if hit by one of the corner balls. A finger loop 36 of metal, plastic, or any other suitable material is attached to the center of the netting material so that a person can easily hook a finger in the loop for the purpose of throwing or flinging the device.

The device has been shown with five corners. The device could be made with more or fewer corners; however, if made with fewer corners, it will not open and spread out as shown as easily when thrown.

In operation, a person hooks a finger in the finger loop 36 and rotates the device over his head, and at the proper time, the finger is unhooked from the finger loop 36 and the device will sail through the air. Because of the weight of the balls 34, the device will open-up and spin in the air, as the device moves from the person throwing the device toward a person to catch the device. The person catches the device and then that person can hook a finger in the finger loop 36 and throw the device back to the person who first threw the device, or the device can be thrown to another person. Each person in turn will catch and then throw the device until he becomes tired of the game. The device can be used indoors as well as outdoors. The game device can then be folded to form a smaller device so that it can be stored in a small space until used again.

In order to provide a picturesque device, the netting can be formed with different knit designs and different colors. The device could be individualized by knitting a person's name in the netting, by a display of different pictures, etc.

The device shown is only illustrative, and it would be obvious to one skilled in the art that it could be made of different designs.

The foregoing relates to preferred exemplary embodiments of the invention, it being understood that other variants and embodiments thereof are possible within the spirit and scope of the invention, the latter being defined by the appended claims.

What is claimed is:

1. A web slinger device, which comprises, a netting material which extends from a central area to an outer netting area formed with a plurality of first corners, a plurality of flexible spaced cords (22) secured outwardly of said first corners and which form second corners outward of said first corners, weight means secured to each of said second corners, and a finger loop gripper is secured to an area of said netting by which said web slinger device can be thrown by a person.

2. A web slinger device as set forth in claim 1, in which said netting material includes closely knit material.

3. A web slinger device as set forth in claim 2, in which, said plurality of flexible spaced cords are formed by loosely spaced strands of material which border said netting material.

4. A web slinger device as set forth in claim 3, in which, said second corners are directly in alignment with said first corners of said netting material.

5. A web slinger device as set forth in claim 1, in which, said weight means includes a separate ball secured to each of said second corners.

6. A web slinger as set forth in claim 5, in which, each of said balls is made of a material selected from rubber, plastic, or foam.

* * * * *